US005526621A

United States Patent [19]

Shelton

[11] Patent Number: 5,526,621

[45] Date of Patent: Jun. 18, 1996

[54] VENTILATED ATHLETIC FLOORING SYSTEM

[76] Inventor: Floyd Shelton, 803 Jefferson St., Wausau, Wis. 54401

[21] Appl. No.: 385,979

[22] Filed: Feb. 9, 1995

[51] Int. Cl.[6] ..... E04B 1/70

[52] U.S. Cl. ..... 52/302.1; 52/403.1; 52/480; 454/270

[58] Field of Search ..... 52/302.1, 302.3, 52/408, 409, 410, 480, 403.1; 454/247, 251, 270

[56] References Cited

U.S. PATENT DOCUMENTS

| | | | |
|---|---|---|---|
| 4,290,798 | 10/1981 | Schramm | 52/302.3 X |
| 4,507,901 | 4/1985 | Carroll | 52/302.3 |
| 4,642,958 | 2/1987 | Pewitt | 52/302.3 |
| 5,297,992 | 3/1994 | Barley et al. | 52/302.3 X |
| 5,299,401 | 4/1994 | Shelton | 52/393 |
| 5,433,050 | 7/1995 | Wilson et al. | 52/302.1 |

*Primary Examiner*—Creighton Smith
*Attorney, Agent, or Firm*—Russell L. Johnson

[57] ABSTRACT

A flooring system which has a subflooring structure that is made up of two or more layers of boards laid across each other and spaced apart from each other to create an interconnected labyrinth of void spaces in the subfloor between a finished top floor and a base, an air moving device for moving air through the labyrinth to ventilate the subfloor structure and thereby reduce potentials for damage to the flooring system due to moisture build-up under the finished floor, and a humidistat positioned in the labyrinth of void spaces to detect moisture build-up and to activate the air moving device.

4 Claims, 1 Drawing Sheet

FIGURE 1
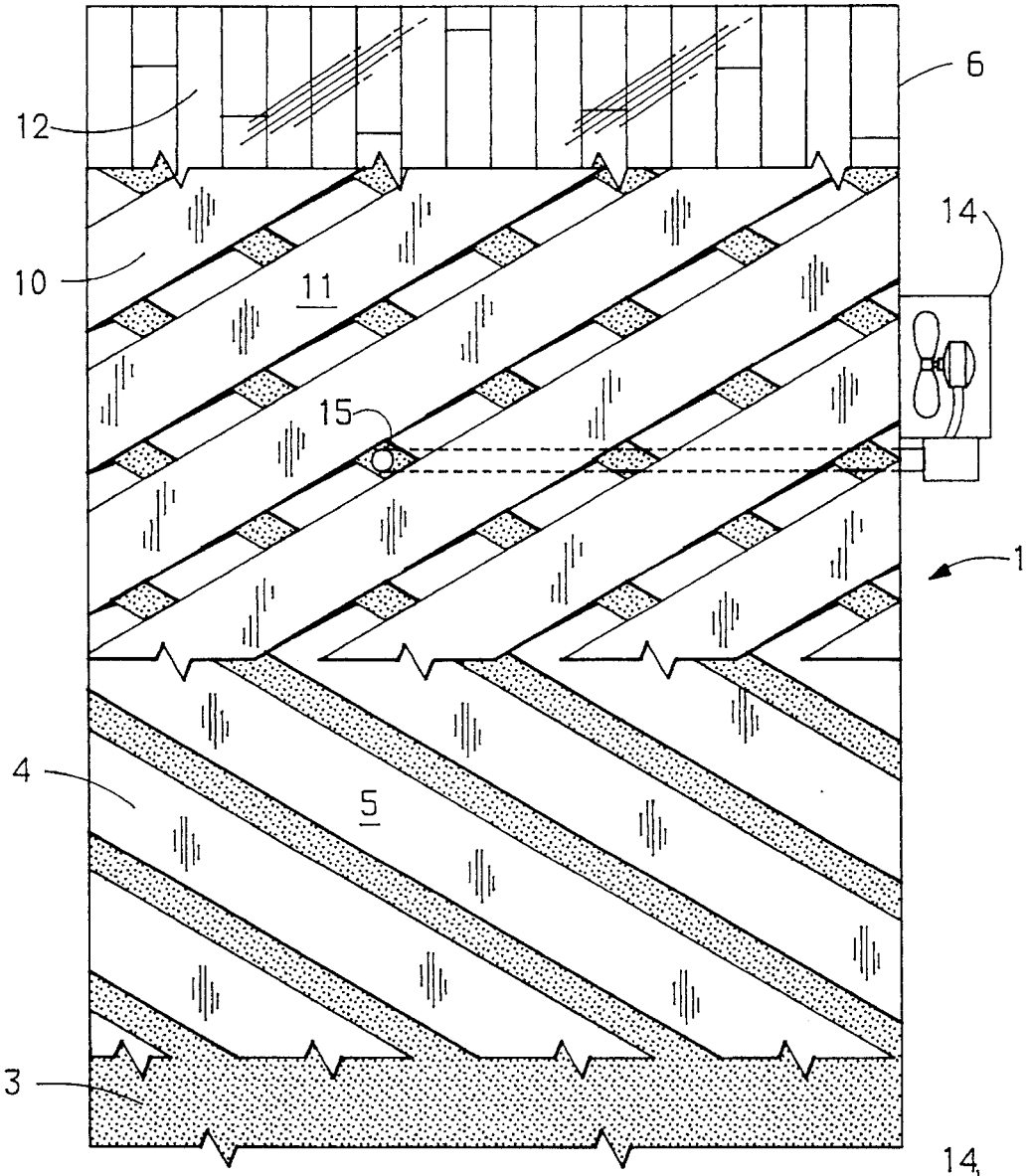
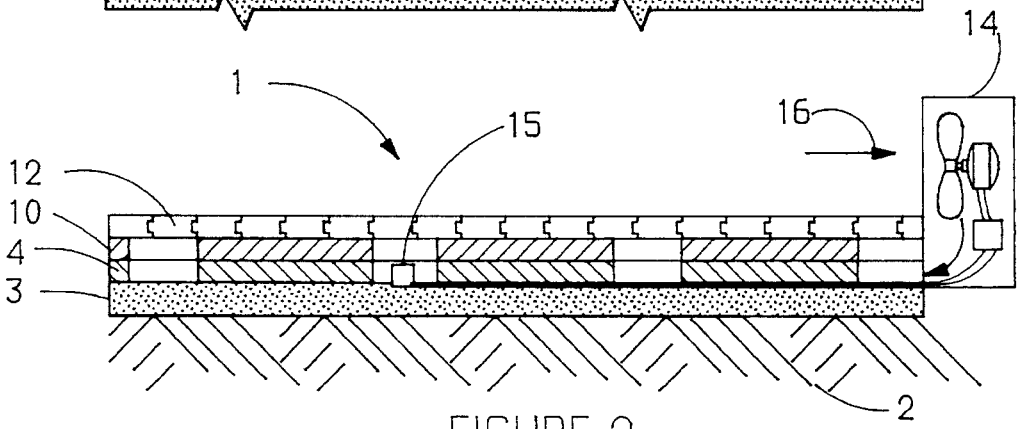
FIGURE 2

VENTILATED ATHLETIC FLOORING SYSTEM

BACKGROUND

Athletic flooring systems have become very sophisticated in the last quarter of the twentieth century. Athletic floors are being installed in some instances in venues where there is not adequate environmental controls to maintain the desired low levels of humidity necessary for maintaining stability in these sophisticated athletic flooring systems. Heretofore, if an attempt has been made to install an athletic flooring system in a venue that is not adequately environmentally controlled, a system of expensive and unreliable "fixed" flooring structures and large subfloor air circulation systems have been employed, sometimes successfully.

OBJECTS

It is an object of this invention to provide a modern floating scissors lock athletic flooring system wherein the subflooring of the system is ventilated by a small number of air movers which move air throughout the flooring system, so as to maintain a desired level of humidity within the flooring system.

It is further an object of this invention to provide the flooring system as described above wherein at least one humidistat is located in a void in the subflooring system and the humidistat provides signals to a controller that regulates the operation of the air mover.

It is further an object of this invention to provide the flooring system described above wherein a modern athletic flooring system having the physical properties desired in modern athletic floors is achievable in venues heretofore seen as hostile to modern athletic flooring systems and to do so at an installation and operating cost that has not heretofore been achieved.

Other objects will become apparent from the following specifications, drawings, and claims.

PRIOR ART

Scissors lock floating athletic flooring systems have long been known in the art. Their limited use is due in part to the cost and difficulty of installing the earlier designs of this flooring system. This inventor has recently developed and patented (U.S. Pat. No. 5,299,401, to Shelton, April 1994), a scissors lock floating athletic flooring system which significantly reduces the costs and difficulties of installing a scissors lock system, and further provides an athletic flooring system that has the physical properties seen as desirable in modern athletic flooring systems.

Under-the-floor ventilation has been attempted in some instances in the past. These attempts have generally been in conjunction with a fixed sleeper type of construction and are expensive to install and operate and of limited and unreliable effectiveness.

The inventor knows of no prior art ventilated floating athletic flooring constructions that utilize a labyrinth of interconnected void spaces in the subflooring construction and has an air mover or movers positioned along a portion of one side of the flooring system so as to reliably provide subfloor ventilation for the entire flooring system.

BRIEF DESCRIPTION

The invention in its simplest form is a ventilated athletic flooring system of scissors lock construction wherein the boards that make up the subfloors are spaced apart and the boards of the first subfloor intersect the boards of the second subfloor so as to create an interconnected labyrinth of voids in the subfloor between the top floor and the base, and a humidistat located in a void space in the subflooring is operably connected to an air mover located along a portion of one edge of the flooring so as to move air through the interconnected labyrinth of voids in the subflooring so as to ventilate the flooring system to a degree that is needed to counteract humidity build up in the flooring system.

BRIEF DESCRIPTION OF THE DRAWINGS

FIG. 1 is a partially sectioned fragmentary plan view of the flooring system of this invention.

FIG. 2 is a sectioned elevational view of the flooring system of FIG. 1.

DETAILED DESCRIPTION

In the drawings like numbers refer to like objects and the proportions of some elements of the drawings have been modified to facilitate illustration.

Referring now to FIGS. 1 and 2 wherein flooring system 1 has base 2 which is typically formed of concrete or asphalt. Pad 3 rests upon base 2 and is typically of closed cell synthetic resilient foam material. First subfloor 4 rests upon pad 3 and first subfloor 4 is formed of boards 5 typically of spruce-pine-fir and laid at an angle to an outside edge 6 of flooring system 1 and boards 5 are laid parallel to each other and spaced apart from each other as shown. Second subfloor 10 rests upon first subfloor 4 and second subfloor 10 is formed of boards 11 typically of spruce-pine-fir and laid at an angle to edge 6 of flooring system 1 and boards 11 are laid parallel to each other and spaced apart from each other as shown. Boards 11 cross boards 5 at an angle as shown. Top floor 12 rests upon second subfloor 10 and top floor 12 is formed of a quality hardwood such as hard maple.

The above described configuration results in subfloors 4 and 10 creating a labyrinth of interconnected voids closed at the top by top floor 12 and closed at the bottom by base 2. In most flooring venues the outside edges of the flooring system do not closely abut the walls of the venue and permit the ready movement of air into and out of the subfloor area.

In venues that create situations where moisture can build up in the flooring system, moisture damage and even floor destruction can occur due to moisture buildup. It is therefore desirable, in such circumstances to ventilate the flooring system so that air can be circulated through the flooring system so as to prevent moisture buildup.

In the past, flooring systems have been constructed using fixed sleepers to create a multiplicity of discrete air ducts that crossed beneath the top floor. Air movers that extended along one side of the flooring venue and moved air through each of the discrete air ducts beneath the floor were employed to ventilate the subfloor.

It has been discovered by the inventor that if a labyrinth of interconnected voids is established under the top floor, and air is moved through the labyrinth by means of an air mover shown schematically as air mover 14 in the drawings and the air mover is activated by means of signals generated by a humidistat 15 positioned in the interconnected voids, and operably connected to air mover 14, that such a system can satisfactorily ventilate the flooring system.

It has further been discovered that an air mover 14 located along only a portion of one side of the flooring system is adequate to ventilate the entire flooring system, thereby providing a savings in installation, operating and maintenance costs of the air mover.

It has further been discovered that if care is taken in the sizing and positioning, and combining of the elements of the system the flooring system of this invention can provide a ventilated athletic flooring system with attributes in ball rebound, force attenuation, and point and area deformation that are comparable to those of other high quality modern athletic flooring systems.

Because the conditions that give rise to the need for a ventilated athletic flooring system are seldom the same from one venue to the next, no set combinations of elements will serve the needs of all the venues. Therefore the best mode of practicing the invention will be dependent upon the conditions prevailing in the specific flooring venue under consideration.

However some general conditions can be disclosed to serve to reduce the amount of experimentation needed to determine the combination of elements that will best serve a particular venue.

The ventilated floating athletic flooring system of this invention can be achieved without the presence of a pad 3. However, it has been found that a pad 3 is a desirable interactive element in modern high performance athletic flooring systems. Pad thicknesses of up to three-fourths of an inch have been found to serve satisfactorily for pad 3.

Boards 5 and 11 are typically nominal one by sixes or one by eights with board widths ranging between two inches and twelve inches and board thicknesses ranging between one half and one inch have been found to be satisfactory in practicing the invention.

Boards 5 and 11 are typically spaced apart a distance of at least one inch and sometimes as much as eight inches or more. It has been found that spacing boards 11 of second subfloor 10 closer together than the spacing of boards 5 of first subfloor 4 will generally result in improved physical properties of the subflooring system.

Humidistat 15 is preferably an industrial grade humidistat that will fit in the voids of flooring system 1 and has reliable accuracy in the lower ranges of humidity measurement.

Air mover 14 is preferably of the fan and duct type. Air mover 14 is typically of a length less than the length of edge 6 of flooring system 1 with which it is associated. In some installations, air mover 14 can be less than one fourth the length of edge 6 of flooring system 1.

In operation, ambient air is drawn into air mover 14 as shown by arrow 16 and the air is discharged by air mover 14 into the labyrinth of void spaces between outside floor 10 and base 2. Humidistat 15 activates air mover 14 when higher than desirable humidity buildup is detected in the void volumes between outside floor 10 and base 2. The air is discharged through gaps in the perimeter of floor 1. The combination of air circulation and moisture equilibration thus achieved are sufficient to maintain the moisture levels in the flooring system within acceptable limits in all but the most severe circumstances.

The above disclosure is enabling and teaches the best mode of practicing the invention known to the inventor at the time of preparation of the patent application.

However, it should be apparent that numerous variants of the invention are within the scope of the inventive concept disclosed above and that to present each of these potential variants would greatly multiply the drawings and cause the specifications and claims to become prolix.

Therefore the scope of this invention should not be restricted to the disclosed embodiments, but should only be limited to the scope of the appended claims and all equivalents thereto which would become apparent to one skilled in the art.

I claim:

1. A ventilated athletic flooring system comprising;

a) a base, b) a first subfloor that rests upon the base and the first subfloor is formed of rows of boards laid parallel to each other and the rows of boards are spaced apart from each other, c) a second subfloor that rests upon the first subfloor and the second subfloor is formed of rows of boards laid parallel to each other and the rows of boards of the second subfloor are spaced apart from each other and the boards of the second subfloor intersect the boards of the first subfloor at an angle, d) a finished top floor that overlays the second subfloor so as to create an enclosed labyrinth of interconnected voids between the top floor and the base, e) at least one humidistat positioned in a void location in the subfloors, and f) at least one air mover operably connected to said humidistat and the air mover is responsive to signals generated by said humidistat and the air mover is configured so as to move air from over the finished top floor into the labyrinth of interconnected void spaces between the top floor and the base.

2. The athletic flooring system of claim 1 wherein the air mover has a length less than the length of a side of the flooring system with which the air mover is associated.

3. A ventilated athletic flooring system comprising;

a) a base, b) a pad that rests upon the base, c) a first subfloor that rests upon the pad and the first subfloor is formed of rows of boards laid parallel to each other and the rows of boards are spaced apart from each other, d) a second subfloor that rests upon the first subfloor and the second subfloor is formed of rows of boards laid parallel to each other and the rows of boards of the second subfloor are spaced apart from each other and the boards of the second subfloor intersect the boards of the first subfloor at an angle, e) a finished top floor that overlays the second subfloor so as to create an enclosed labyrinth of interconnected voids between the top floor and the base, f) at least one humidistat positioned in a void location in the subfloors, g) at least one air mover operably connected to said humidistat and the air mover is responsive to signals generated by said humidistat and the air mover is configured so as to move air from over the finished top floor into the labyrinth of interconnected void spaces between the top floor and the base.

4. The flooring system of claim 3 wherein the pad has a maximum thickness of three-fourths of an inch.

* * * * *